US005678899A

United States Patent [19]

Lewis, Jr.

[11] Patent Number: 5,678,899

[45] Date of Patent: Oct. 21, 1997

[54] PRE-CONFIGURED BRUSHWARE AND METHOD OF FUSING

[75] Inventor: John C. Lewis, Jr., Salisbury, Vt.

[73] Assignee: Tucel Industries, Inc., Forest Dale, Vt.

[21] Appl. No.: 540,504

[22] Filed: Oct. 10, 1995

Related U.S. Application Data

[60] Division of Ser. No. 198,704, Feb. 18, 1994, abandoned, which is a continuation-in-part of Ser. No. 137,537, Oct. 18, 1993, Pat. No. 5,511,274.

[51] Int. Cl.[6] ..... B02C 3/00

[52] U.S. Cl. ..... 300/21

[58] Field of Search ..... 300/21; 264/243, 264/230; 15/160, 167.1, 167.2, 186, 187, 159.1, 207.2, 191.1

[56] References Cited

U.S. PATENT DOCUMENTS

| | | | |
|---|---|---|---|
| 3,344,457 | 10/1967 | Girobert | 15/207.2 |
| 3,604,043 | 9/1971 | Lewis, Jr. | 15/159 |
| 4,189,189 | 2/1980 | Lewis, Jr. | 300/7 |
| 4,291,431 | 9/1981 | Lewis, Jr. | 15/160 |
| 4,329,755 | 5/1982 | Alissandratos | 15/160 |
| 4,348,060 | 9/1982 | Lewis, Jr. | 15/160 |
| 4,646,381 | 3/1987 | Weihrauch | 15/187 |
| 4,690,277 | 9/1987 | Lewis, Jr. | 15/167.1 |
| 4,693,519 | 9/1987 | Lewis, Jr. | 300/7 |
| 5,014,383 | 5/1991 | Costar | 15/160 |
| 5,027,463 | 7/1991 | Daub | 15/167.1 |
| 5,345,646 | 9/1994 | Rothweiler | 15/167.1 |

*Primary Examiner*—Mark Rosenbaum
*Attorney, Agent, or Firm*—Donald C. Casey

[57] ABSTRACT

The method of fusing brushware is disclosed whereby the molded component upon being tufted with synthetic filament, has a configured one-piece construction having both chemical and physical properties, which contribute to the straightness of the finished brushware where required and resulting in the working ends of said brushware being in the same attitude and configuration as the surface being cleaned.

10 Claims, 6 Drawing Sheets

PRE-CONFIGURED BRUSHWARE AND METHOD OF FUSING

CROSS REFERENCE TO RELATED APPLICATION

This application is a divisional of Application Ser. No. 08/198,704, filed Feb. 18, 1994, now abandoned, which is a continuation in part of Application Ser. No. 08/137,537, filed Oct. 18, 1993, now U.S. Pat. No. 5,511,274.

FIELD OF THE INVENTION

The invention relates to the manufacturing of fused brushware products that are comprised of only one raw material, thus making the finished products recyclable, if and when they are no longer functional, and imparting chemical and physical properties therein which could not otherwise be attained employing conventional material and configurations so that the resultant brushware is both functionally and cosmetically correct.

DESCRIPTION OF THE PRIOR ART

Many different types of brushware and methods for their manufacture have been devised over the past few centuries starting with ordinary tree and shrub branches, and developing into wire-set, anchor-set, staple-set, twisted-in-wire and resin-set designs including both natural and synthetic filament materials, but not until the method of fusing like materials, i.e., polypropylene monofilament onto a molded section of polypropylene, has the basic brushware configuration changes. Many U.S. Pat. Nos. 3,604,043; 4,189,189; 4,291,431; 4,348,060; 4,690,277; and 4,693,519 issued to John C. Lewis, Jr. disclose tufted fused brush and mat like device wherein synthetic filament tufts are fused to molded base sections. However, there are no disclosures of the improved brushware of the instant invention, wherein a brush or broom construction can be obtained without employing the teachings of the instant invention. The fusing process causes the brushware block to first expand, (take a set or curvature), and upon cooling, causes the block to shrink past its original straight (molded attitude) profile, and thus end with an out-of-line filament working end, which does not facilitate surface cleaning. The fused brushware must be trimmed, so that the working ends of the filaments make contact with the surface. An alternative means for straightening the working ends of the fused brushware is to restrain the fused brushware article by first heating the opposite side of the fused block (the non-tufted side), thus causing it to re-orient the molecular structure of the molded block and actually cause more deformation. After a second cooling, the block will return to its original molded configuration.

SUMMARY OF THE INVENTION

The instant invention overcomes the inadequacies in the prior art by providing a pre-configured structural foam or injection molded filament base portion of material extending therefrom a handle or mounting section of the ultimate brushware construction and simultaneously fusing synthetic filament onto the said base portion, said brush construction being made from the same raw material, i.e., polypropylene resin, and being recyclable at some later time. There can be instances where there would be a need to fuse unlike materials for dissimilar constructions, i.e., polypropylene molded base section with polyester monofilament fused thereto.

The improved brushware generally includes a pre-configured molded block means in order to use the brushware effectively and a pre-determined tuft configuration allowing for the most efficient brushing action, which cannot be achieved employing ordinary brush making technology. The resultant physical and cosmetic properties are not obvious to those skilled in the art.

The term "brushware" as used hereinafter includes any device, either a brush or broom, having both synthetic filament and a molded base means including a hand placement area and/or handle means.

The term "synthetic" filament as used hereinafter includes filaments which are formed from linear thermoplastic polymers from the group consisting of polystyrene and polystyrene co-polymers, polyvinyl chloride and polyvinylchloride-acetate co-polymers, polyethylene, polypropylene, polyethylene-polypropylene co-polymers, polyamides, polyesters and polyurethane. Both oriented and unoriented filament may be employed. Also, various filament cross-sections may be imparted, such as for instance, circular, lobular, trifoil, X and Y cross-sections, triangular, polygonal, star, etc. Mixtures of synthetic filaments may be employed in cases where the compositions of the filament are compatible during any fusing operations, i.e., heat-sealing. Such filaments may have suitable crimp imparted to their length or a portion thereof. Filaments may contain organic or inorganic modifications in order to make them biodegradable, or self-decompose during or after use for a given period of time.

The term "picking" as used hereinafter refers to the formation of filament tufts wherein two or more tufts are formed simultaneously by longitudinally engaging more than one cut-to-length filament at its end and removing said filament from a parallel disposed bundle of filaments. The picking devices employed are those types which are disclosed in U.S. Pat. Nos. 3,471,202; 3,910,637; 4,009,910 and 4,109,965, all invented by Lewis.

The term "configured" refers to any design that will become a dimensionally flat shape after a pre-configured curved, two-dimensional structural foam or injection molded thermoplastic block has been fused into a brushware construction by the addition of synthetic filament tufts. If a special out-of-plane finished brushware configuration is desired, the starting shape of the block may be something completely opposite of the norm.

The term "recyclable" refers to any brushware made according to the instant invention and comprised wholly of thermoplastic filament and molded base having the same chemical raw materials, so that when the brushware is ground up, it can be reused to produce a like item, or be used as post-consumer resin to be used for something other than brushware.

It is therefore an object of this invention to provide a flat planed integral one-piece fused filament/block cleaning device and/or brushware device wherein the resulting filament working ends exert continued surface contact as well as extra pressure during use, which is self-supporting and can be securely held in one's hand(s) [or machine driven] during use.

Another object of the instant invention is to provide one-component recyclable, non-polluting flat brushware costing less to manufacture than existing products.

A further object of this invention is to provide a cleaning device which allows fused tuft configurations to lay flat to the cleaning surface.

An additional object of this invention is to provide the method for pre-configuring the molded block means in such a manner that the finished working ends of said brushware are in the same plane as the object to be cleaned.

A further object of this invention is to provide a cleaning device which allows fused, two-dimensional filament tuft working ends to continuously contact the cleaning surface.

These and other objects will become readily apparent with reference to the drawings and following description wherein:

DETAILED DESCRIPTION OF THE INVENTION

Figure 1A:
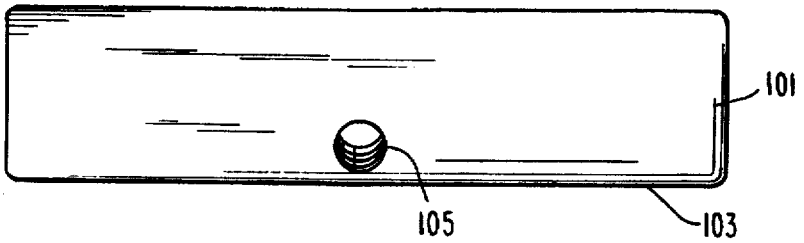
FIG. 1A is an unassembled top view of the filament support of FIG. 1.
Figure 1:
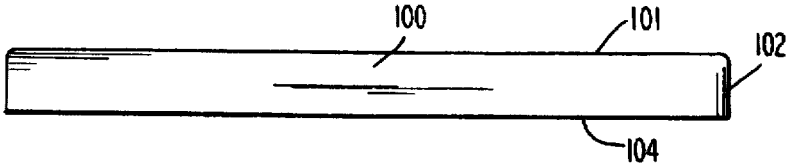
FIG. 1 is a side view of an unassembled conventional single plane molded filament support block member before fusing.
Figure 1B:
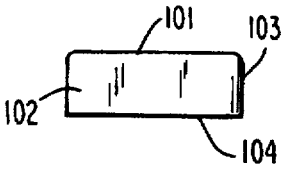
FIG. 1B is an unassembled end view of the filament support of FIG. 1.
Figure 2:
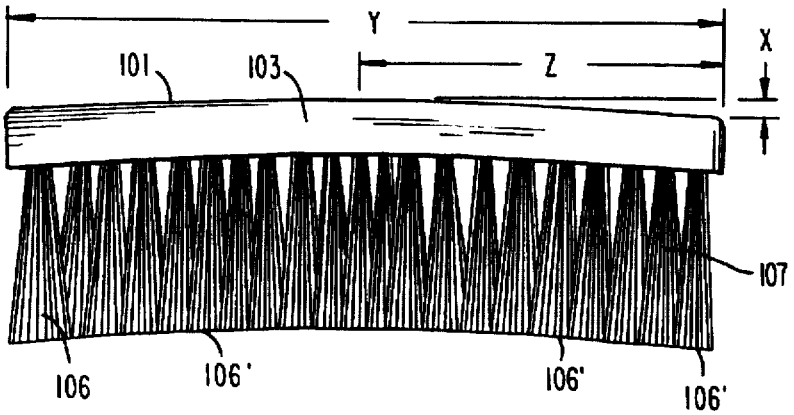
FIG. 2 is a side view of the fused filament support of FIG. 1 after assembling.

Referring to FIG. 1–1B, there is illustrated a polypropylene structural foam molded flat brushware block 100, comprised of a top 101, ends 102, sides 103, a bottom or fusing surface 104 and a hole means 105, said hole 105 having means for holding or attaching a handle device (not shown). When fusing polypropylene filament to said block 100 (simultaneously applying generally 150 to 200 plus individual filament tufts consisting of a group of prefused filaments), the entire bottom or fusing surface 104 is first pre-melted, and upon bringing the prefused filament tufts into contact with the surface 104, the melted and still viscous resin bonds the two components together, upon cooling. When the tufts 106 and the block 100 cool to room temperature, the first change in the plane of the original straight block 100 occurs when the bottom surface takes a convexed curvature, and as cooling sets in, the bottom comes to the original straight plane attitude, and then continues to warp and become concaved as FIG. 2 illustrates. This is explained by the fact that only the bottom surface 104 was heated, therefore, it first expanded, then as it cooled, it returned to its original attitude, and then continued to go past by the amount "X" as illustrated in FIG. 2. A ratio can be determined from taking half the total length "Y" (or "Z") and dividing "Z" into "X" to arrive at a number which is generally in the range from 0.020 inches to 0.040 inches, depending upon the type of molding employed and thickness of the molded parts. Measuring the amount of deflection along half the length "Z" from the original straight block, the amount of difference "X" becomes the significant deviation factor. Taking the ratio of "X" divided by "Z", one gets a figure that allows one to apply to configuring a pre-curved molded surface into a brushware block prior to ever experimenting or constructing a mold. Table 1 below illustrates the ratios for some polypropylene molded blocks.

TABLE 1

(MOLDED POLYPROPYLENE BLOCKS)

| "Z" | "X" | RATIO | TYPE |
|---|---|---|---|
| 0.937 | 0.035 | 0.0373 | Injection Molded |
| 2.375 | 0.055 | 0.0231 | Injection Molded |
| 3.000 | 0.189 | 0.0630 | Injection Molded |
| 7.000 | 0.250 | 0.0357 | Structural Foam |
| 9.000 | 0.275 | 0.0305 | Structural Foam |
| 12.000 | 0.400 | 0.0333 | Structural Foam |

Figure 2A:
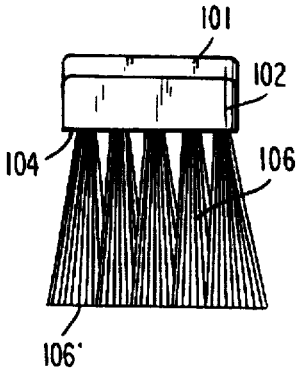
FIG. 2A is an end view of the fused filament support of FIG. 2.

As shown in FIG. 2, the filament tufts 106 and their working ends 106' also take on the same curved distortion as the block surface 104, and consequently, the brushware device 107 will not lay flat to a cleaning surface, i.e., floor. FIG. 2A illustrates the "humping" of the block 100, and the top surface 101 is visible from as shown from the end 102.

During the fusing process, it has been determined that the polypropylene molecules, which were oriented (crystalline) during the molding process, when reheated a second time, contracted more on the fusing surface 104 of the block 100, than on the top surface 101, which was not heated. Essentially, due to applying approximately 800° F. to surface 104, and room temperature remaining on the top surface 101, the result upon cooling is a curved out-of-plane brushware device 107.

Figure 3:
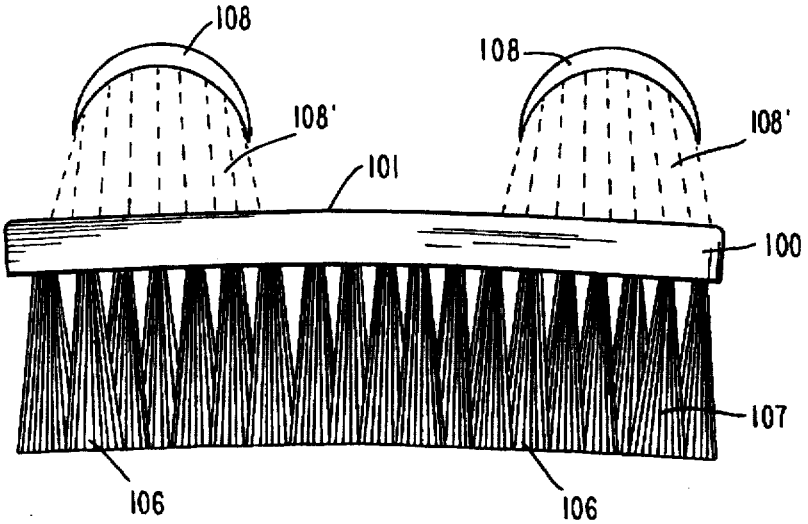
FIG. 3 is a side view of the fused brushware of FIG. 2 located under heating means.
Figure 4:
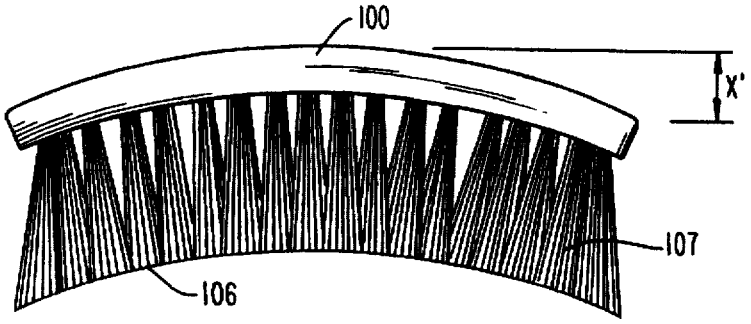
FIG. 4 illustrates the fused brushware of FIG. 3 after having been removed from the heating means.
Figure 5:
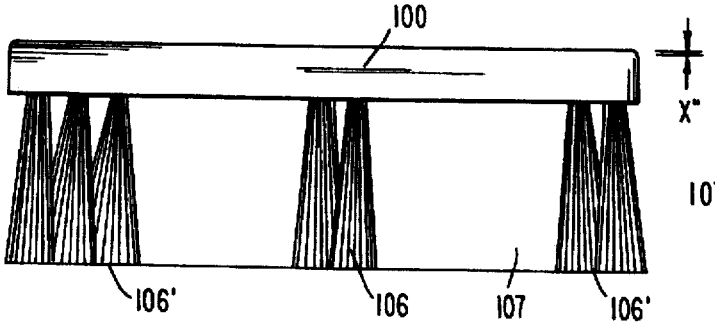
FIG. 5 is a side view of the fused brushware of FIG. 4 after cooling.
Figure 5A:
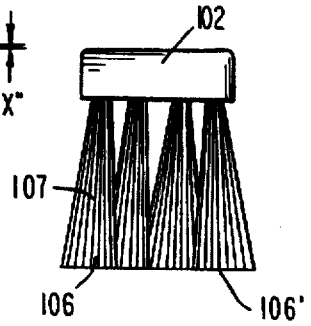
FIG. 5A is an end view of the fused brushware of FIG. 4.

In order to straighten fused brushware, i.e., broom 107, it becomes necessary to heat the top surface of the block 101 as illustrated in FIG. 3, whereby the same procedure used to fuse is applied to the top surface 101 with radiant heaters 108 and allowing the heat 108' to penetrate the top surface 101 of block 100. As this heat is applied, the top surface 100 actually expands, as illustrated in FIG. 4, and thus even creates more curvature to the brushware 107. The deformation or deviation from "X" to (X') is evident on block 100 in FIG. 4 as shown. When the heat is removed and the brushware 107 is allowed to cool, it returns to the normal state of the unfused block 10 as shown in FIG. 5 and 5A where the deviation (X') is basically zero, and the filament working ends 106' lay in a parallel relationship to the surface being cleaned. It normally requires ten minutes heating time to complete this straightening procedure and an additional twenty to thirty minutes to cool the brushware down to room temperature.

The instant invention results in both cosmetically correct and functional brushware through pre-configuring the molded blocks. Pre-configured blocks [molded block with a defined curve] of this instant invention are illustrated in FIGS. 6, 13, 15 and 18; these blocks only serve to illustrate what is possible. As described in the above conventional embodiment for fusing regularly molded brushware blocks, if the fused block is not post straightened, the resulting product will not perform.

Figure 6:
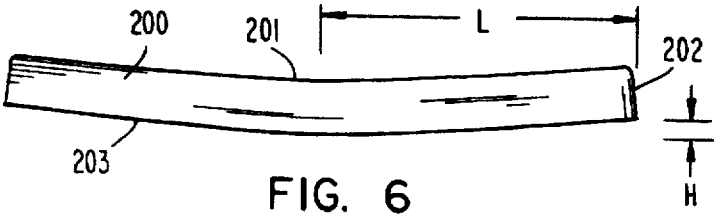
FIG. 6 is a side view of a configured molded block prior to fusing.
Figure 6A:
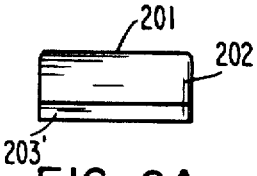
FIG. 6A is an end view of the pre-curved molded block of FIG. 6.

Turning now to the new and improved method of fusing brushware blocks, the pre-molded curve ration [H/L] of FIG. 6 illustrates that the polypropylene structural foam block 200 has a concave top 201, raised end portion 202 and a convex bottom 203. When viewing block 200 from the end as in FIG. 6A, one sees that the bottom portion 203' can be seen directly under the end section 202.

Figure 7:
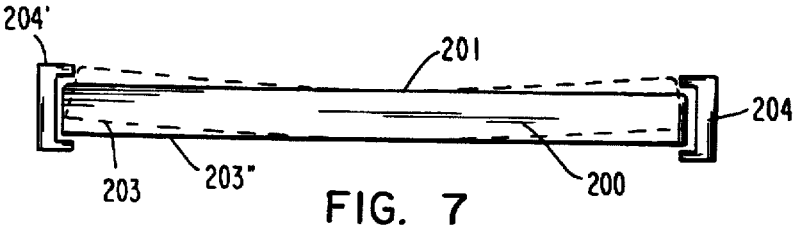
FIG. 7 is a side view of the block of FIG. 6 as located in a block holder device prior to fusing.
Figure 8:
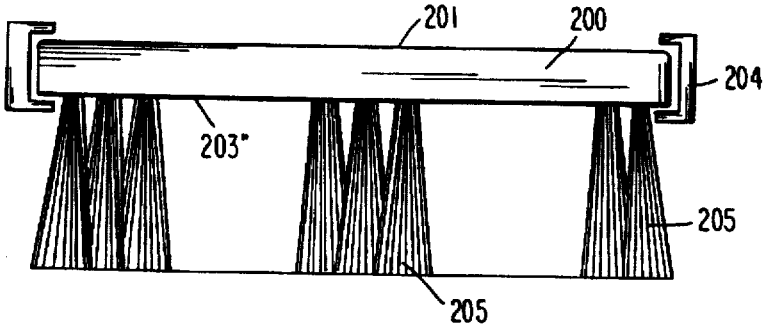
FIG. 8 is a side view of the fused filament support of FIG. 7.
Figure 9:
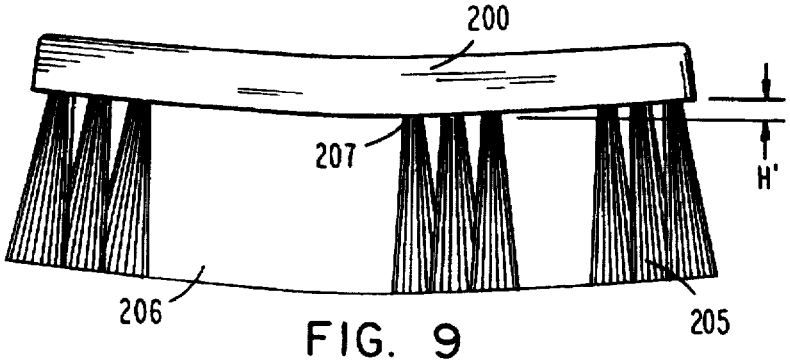
FIG. 9 is an assembled side view of the still warm fused block of FIG. 8 immediately after removal from the block holder device.
Figure 10:
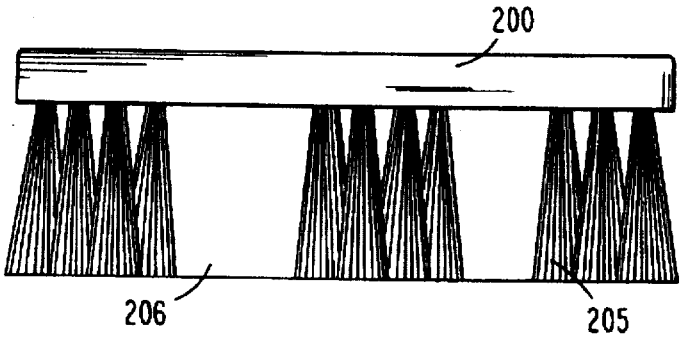
FIG. 10 is a side view of the cooled fused filament/block broom of FIG. 9.
Figure 10A:
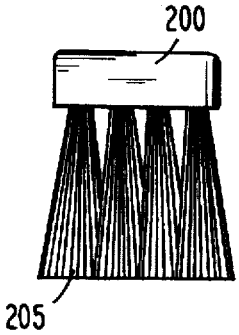
FIG. 10A is an end view of the broom of FIG. 10.

In order to fuse filament onto block 200, it first becomes necessary to mount the block 200 in a straightening fixture 204–204' as shown in FIG. 7. The bottom 203 of the pre-molded curved block 200 has been made to lay in a straight-line plane as illustrated by 203". Ordinary fusing of polypropylene filament onto the flat surface 203" of block 200 is shown in FIG. 8 and produces filament tufts 205, and when the fused broom 206 is removed from the straightening device 204–204', it immediately assumes the original pre-molded curvature profile as shown in FIG. 9 with the deviations H' from a flat surface plane. Upon cooling of the fused filament/block area 107, the block 200 of the broom 206 slowly contracts along the entire fused surface area, thus allowing the pre-molded curve to become straight as illustrated in FIG. 10 and 10A.

Figure 11:
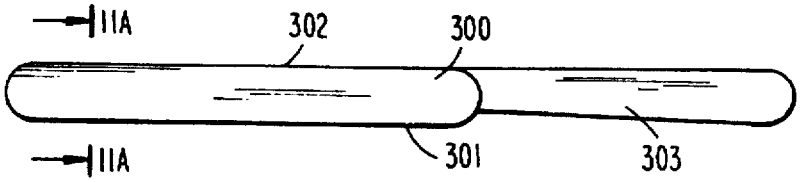
FIG. 11 is a side view of a conventional molded bench brush block.
Figure 11A:
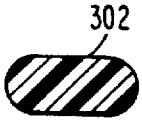
FIG. 11A is a cross-sectional view of FIG. 11 as taken along line C—C.
Figure 11B:
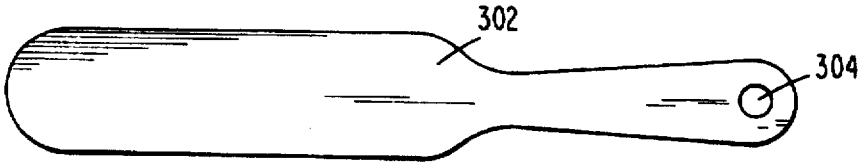
FIG. 11B is a top view of FIG. 11 further illustrating the shape of the block of FIG. 11.
Figure 12:
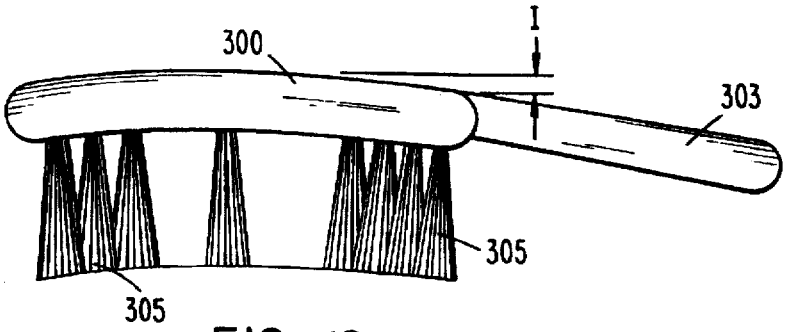
FIG. 12 is a side view of the fused block of FIG. 11.

FIGS. 11, 11A, 11B and 12 illustrate an ordinary structural foam molded polypropylene block 300 which normally would be molded with a straight profile in order to staple-set filament tufts therein, and what will happen instead when filament tufts are fused thereon. The block 300 is comprised of a straight top section 302 and bottom section 301 and a straight portion of handle 303. The cross-section of FIG. 11A was taken through lines C—C of FIG. 11. FIG. 11B illustrates the top view with top 302 and hang-up hole 304. When ordinary fusing of polypropylene filament tufts 305 are fused to the bottom surface 301, and allowed to cool as in FIG. 12, the block 300 becomes curved and has a deviation of "T". One should note that the handle section 303 does not become affected by the fusing process and remains straight.

Figure 13:
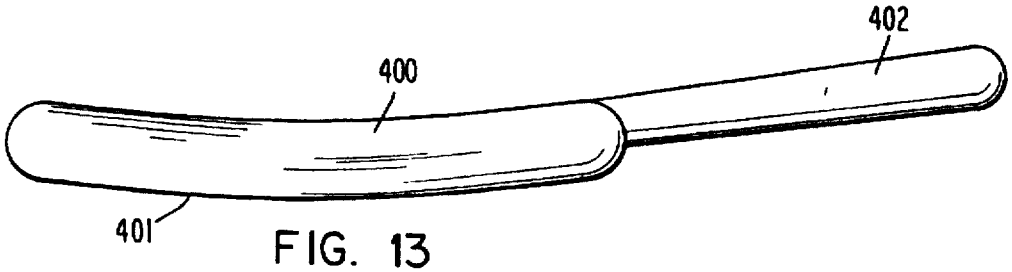
FIG. 13 is a side view of a configured bench brush block prior to fusing.
Figure 14:
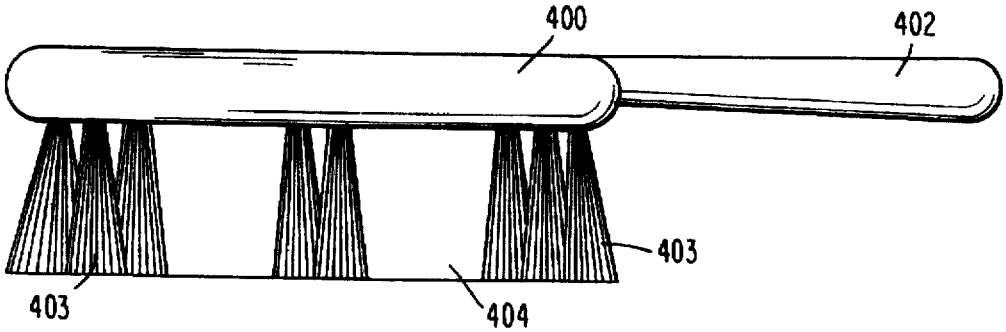
FIG. 14 is a side view of the cooled fused bench brush block of FIG. 13.

In order to fuse a straight brush 404, i.e., bench brush, it becomes necessary to first mold a configured structural foam block 400 as illustrated in FIG. 13 having a convexed fusing surface 401. The molded block, in this case, may contain handle section 402, which is molded in a straight plane and, as in this embodiment, wants to remain straight in the finished fused brush 404. After fusing polypropylene filament tufts 403 to the curved surface of 401 of FIG. 13, the brush 404 of FIG. 14 becomes straight after a few minutes of cooling, and the pre-configured molding curve becomes straight.

The above-mentioned embodiments of this invention were illustrations drawn for structural foam molded blocks where the thickness of the blocks are generally in the order of 0.250 to 1.000 inches thick. Attention is now drawn to injection-molded block means whereby the thickness range is generally from 0.050 to 0.250 inches.

Figure 15A:
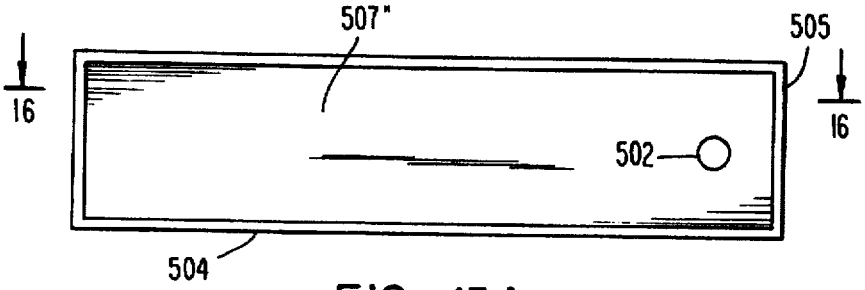
FIG. 15A is a top view of FIG. 15.
Figure 15:
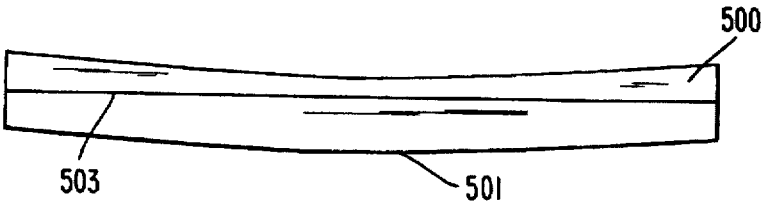
FIG. 15 is a side view of a configured nail brush block prior to fusing.
Figure 15B:
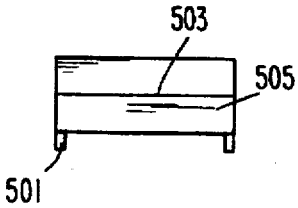
FIG. 15B is an end view of FIG. 15.
Figure 16:
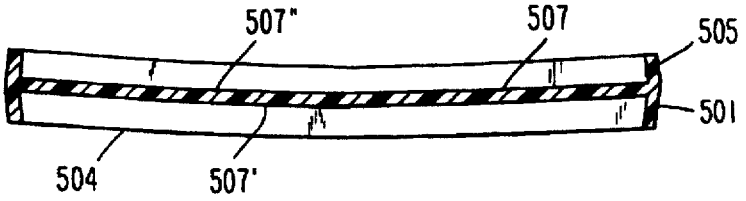
FIG. 16 is a cross-sectional view of FIG. 15A as taken along lines D—D.
Figure 17:
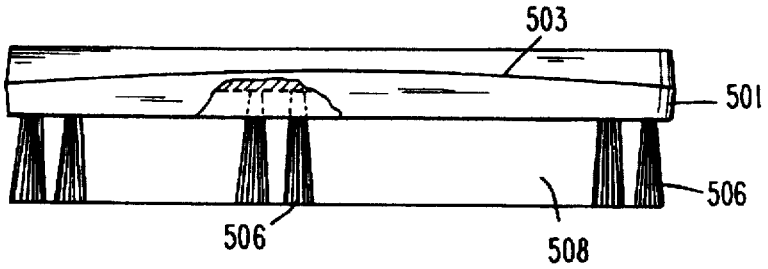
FIG. 17 is a side cut-away view of FIG. 15 after fusing and cooling of the block.

The small nail brush unit measuring approximately 4 inches long, 1.5 inches wide and appears to have a thickness of 0.5 inches is shown in FIG. 15 whereby a pre-configured curve has been molded into the block 500, having ends 501 and a straight parting line 503. FIG. 15A illustrates the top view consisting of sides 504, ends 505 and a hang-up hole 502. FIG. 15B shows the end view of the block 500 with projections 501 extending downward from sides 504. The extending of sides 504 are only appearing to be longer from the end view, but are, in fact, parallel sides of equal width. FIG. 16 illustrates the cross-sectional view of block 500 as taken through lines D—D of FIG. 15A and, as can be seen, the actual fusing portion (filament accepting surface) 507 is comprised of a bottom surface 507' and top surface 507", each surface being pre-molded into convexed for 507' and concaved for 507". After fusing polypropylene tufts to the surface 507' and allowing for cooling, the block 500 cools to a straight, parallel-sided nail brush 508 having a curved parting line 503' with a flat brush surface as illustrated in FIG. 17.

Figure 22:
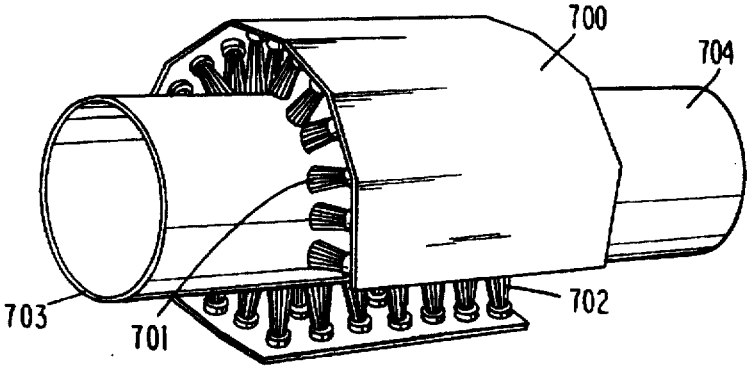
FIG. 22 is a perspective view of a pipe cleaning brushware configuration as it relates to the instant invention.

There are some brush constructions, for example, brush 702 of FIG. 22, whereby it is advantageous to have the brush surface 701 configured in such a manner that it has to conformto a given for cleaning, i.e., an ordinary pipe 703. In order to allow an internally radiating brush working surface conform to a pipe's outside convex surface, it becomes necessary to construct a brush 702 unit having special properties being that all of the working brush surface 701 touch and clean the pipe's surface 704 at once, as illustrated in FIG. 22.

Figure 18:
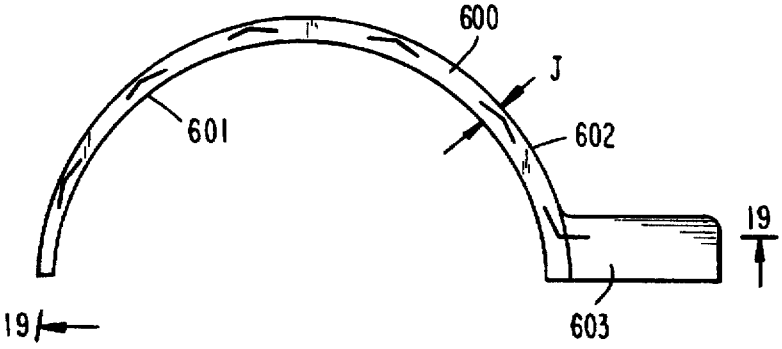
FIG. 18 is a side view of a molded brushware block illustrating a premolded curvature.

The following embodiment will illustrate that by molding a block 600 of FIG. 18 and deliberately configuring a predetermined curvature that will further contract when fused into the injection-molded block, so as the fused brush block working filament ends will lay congruent with the surface to be cleaned as well as exert pressure thereon simultaneously.

Figure 18B:
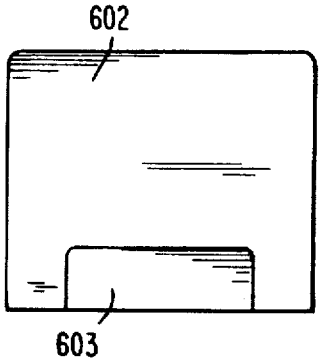
FIG. 18B is an end view of FIG. 18.
Figure 20:
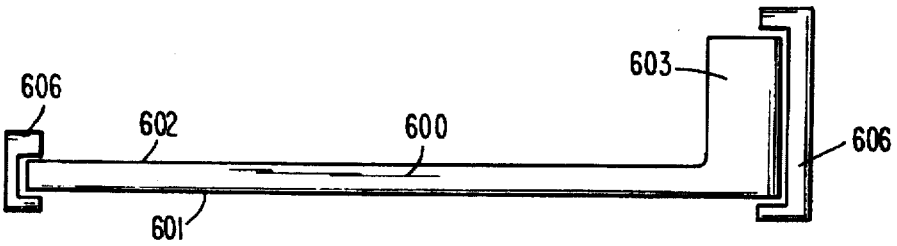
FIG. 20 is a side view of the block of FIG. 18 as located in a block holder device prior to fusing.
Figure 18A:
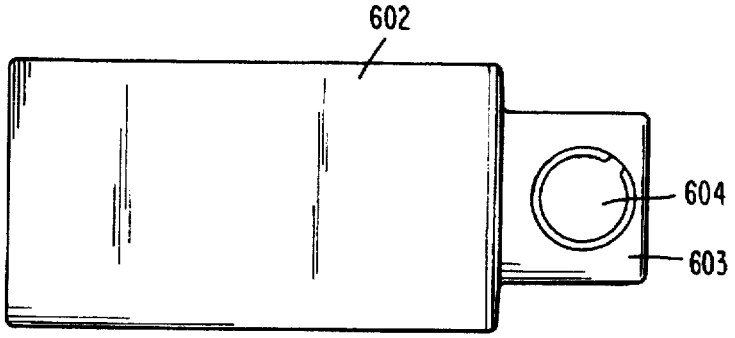
FIG. 18A is a top view of FIG. 18.
Figure 19:
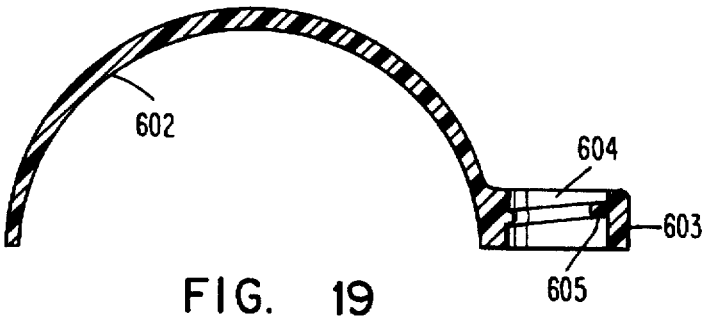
FIG. 19 is a cross-sectional view of FIG. 18 as taken along lines E—E.
Figure 21:
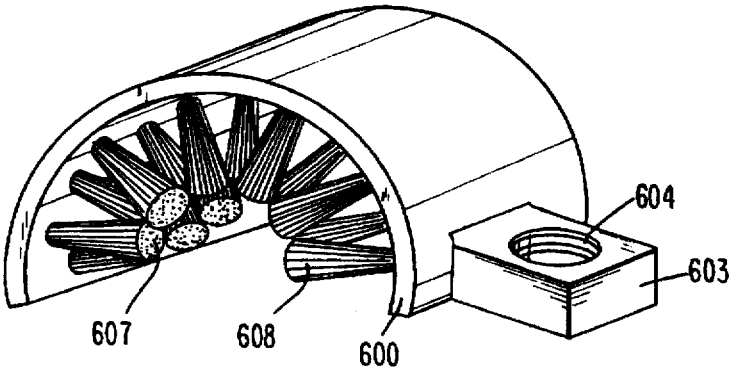
FIG. 21 is a perspective view of the cooled fused brushware block of FIG. 18 after removal from the block holder device.

In FIG. 18, the block 600 has a fusing surface 601 adjacent to a top surface 602 and integrally connected to an extending threaded protrusion 603. The block 600 thickness J, in this instance, can be in the order of 0.0.80 to 0.150 inches. The FIGS. 18A and 18B illustrate the top and end view respectively, showing threaded hole 604 as molded into extension 603. FIG. 19 further illustrates a cross-sectional view of the integrally molded "curved" block 600 as taken through lines E—E of FIG. 18, and defines the thread 605 of hole 604. The concaved surface 601 will be able to accept fused filament when the block 600 is affixed into a straightening fixture 606 as illustrated in FIG. 20.

After fusing filament tufts onto surface 601 of block 600 and cooling is completed, the fused brush 608 is curved having a smaller diameter than the original molded block 600 and brush tufts 607 all converging toward the center of the brush construction 608.

It should be noted that the brush constructions of this instant invention are one and two dimensional whereby the brush tufts generally like along one plane, and all parallel in one plane to one another, and that three dimensional fused brush constructions are the specific subject matter of my co-pending U.S. patent application Ser. No. 08/137,537, as filed on Oct. 18, 1993.

Obviously, many modifications and variations of the instant invention are possible in light of the above teachings. The device may be made from polypropylene, molded resin and fused synthetic polypropylene monofilament as the preferred material, however, other synthetic resins such as polyesters, polystyrenes, polyamides and the like may be employed. Filament diameters and cross-sectional shapes may also be varied, with diameters ranging from 0.005 through 0.050 inches and cross-sectional shapes from circular, "X", "Y" and other shapes, thus imparting different cleaning attributes within the block structure.

The molded base member(s) may have a circular shape as well as any polygonal shape as long as it is possible to configure a two-dimensional space to accept a brush configuration. Either the upper or lower side of the molded surface may contain rib or structural fin-like projections in order to reinforce tufted surfaces for ultimate strength but not sacrifice the lightweight properties of the resultant brushware. There are unlimited brushware designs that can now be manufactured. All three methods of producing molded blocks (structural foam molding, injection molding and blow molding) are acceptable for the configuring of blocks to be employed in this instant invention. The molded base section is not limited to injection molding, but can be blow-molded as well, wherein a thin, integrally projecting configured sheet area is provided thereon and the blow-molded portion acts as a handle/container means for a liquid.

Instantaneously picking and fusing of all the filament tufts in one plane and parallel filament arrangement into a two-dimensional brushware device can only be achieved by practicing the instant invention.

It will be readily seen by one of ordinary skill in the art that the present invention fulfills all of the objects set forth above. After reading the foregoing specification, one of ordinary skill will be able to effect various changes, substitutions of equivalents and various other aspects of the invention as broadly disclosed herein. It is therefore intended that the protection granted hereon be limited only by the definition contained in the appended claims and equivalents thereof.

We claim:

1. The method of fabricating a brushware device wherein a plurality of tufts of cut-to-length filament are each fused at a nonworking end and mounted on a heat-softened surface of a brush block and then permitted to cool and thereby become attached thereto forming said device having the working ends of said tufts contained in a plane parallel to said cooled brush block surface, comprising:

molding a pre-configured curved thermoplastic block having a deflection ratio of 0.020 to 0.060 inches and a tuft mounting surface in a first configuration;

subjecting said molded block to straightening means prior to fusing whereby said block and surface define a second configuration;

picking and fusing a plurality of synthetic thermoplastic filament tufts each at a nonworking end, heat softening said block and mounting the fused tuft ends onto one side of said pre-curved block;

allowing said fused block to cool;

whereby there results a brushware construction having its brush filament working ends contained in a predetermined third configuration.

2. The method of fabricating a brushware device of claim 1 whereby said molded block and filament tufts are comprised of polypropylene resulting in a brushware device that is completely recyclable.

3. The method of fabricating a brushware device of claim 1 whereby said molded block is comprised of polypropylene and said filament tufts are comprised of polyester.

4. The method of fabricating a brushware device wherein a plurality of tufts of cut-to-length filament are each fused at a nonworking end and mounted on a heat-softened surface of a brush block and permitted to cool whereby said tufts become attached to said surface comprising: molding a pre-configured thermoplastic curved block having a deflection ratio of 0.020 to 0.060 inches and having a tuft receiving surface in a first configuration;

subjecting said molded block to straightening means whereby said surface thereof assumes a second configuration prior to fusing;

picking and fusing a plurality of synthetic thermoplastic filament tufts, heat softening said block surface and mounting said fused tuft ends thereon;

allowing said fused block and tuft ends to cool and further contract;

whereby said surface assumes a third predetermined configuration and there results a brushware construction having its tuft filament working ends in said third predetermined configuration.

5. The method of fabricating a brushware device of claim 4 wherein said molded block means and filament tufts are comprised of identical thermoplastic resins resulting in a brushware device that is recyclable.

6. The method of fabricating a brushware device of claim 4 whereby the molded block is blow-molded.

7. The method of claim 4 wherein said third configuration is a plane.

8. The method of claim 7 wherein said second and third configurations each are a plane, and said first configuration is not.

9. The method of claim 4 wherein the step of subjecting said block to straightening means includes holding said block in said second configuration while said surface is heat softened and said fused tuft ends are mounted thereon.

10. The method of claim 4 wherein said block surface is rectangular and said first configuration is concave along the longitudinal axis thereof.

* * * * *